US006600895B2

(12) United States Patent
Fletcher et al.

(10) Patent No.: US 6,600,895 B2
(45) Date of Patent: Jul. 29, 2003

(54) PRINTING MACHINE AND METHOD USING A BIAS TRANSFER ROLLER INCLUDING AT LEAST ONE TEMPERATURE-MAINTAINING DEVICE

(75) Inventors: Gerald M. Fletcher, Pittsford, NY (US); Edward L. Schlueter, Jr., Rochester, NY (US); Shawn R. Rowan, Webster, NY (US); Eugene J Fina, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/864,158

(22) Filed: May 25, 2001

(65) Prior Publication Data

US 2002/0176723 A1 Nov. 28, 2002

(51) Int. Cl.[7] ..... G03G 15/16
(52) U.S. Cl. ..... 399/307; 399/308
(58) Field of Search ..... 399/302, 307, 399/308, 94, 66

(56) References Cited

U.S. PATENT DOCUMENTS 3,893,761 A * 7/1975 Buchan et al. ..... 118/106
4,430,412 A * 2/1984 Miwa et al. ..... 118/60
4,455,079 A * 6/1984 Miwa et al. ..... 399/148
5,321,476 A 6/1994 Gross
5,778,292 A * 7/1998 Arends et al. ..... 219/216
6,002,907 A * 12/1999 Berkes ..... 399/148
6,088,565 A 7/2000 Jia et al.
6,141,524 A 10/2000 Berkes et al.
6,173,147 B1 * 1/2001 Nakashima et al. ..... 399/302
6,259,880 B1 * 7/2001 Jia et al. ..... 399/302
6,332,067 B1 * 12/2001 Domoto ..... 219/216

FOREIGN PATENT DOCUMENTS

JP 04318579 A * 11/1992 ..... G03G/15/16
JP 2000-310910 A * 11/2000 ..... G03G/15/16

* cited by examiner

*Primary Examiner*—Robert Beatty
(74) *Attorney, Agent, or Firm*—Oliff & Berridge, PLC

(57) ABSTRACT

A printing apparatus includes a transfuse member, an intermediate transfer member and a transfer member that electrostatically transfers a toner image from the intermediate transfer member to the transfuse member. The transfer member includes at least one temperature control device that maintains the transfer member within a predefined range. A controller assembly may be connected to the at least one temperature control device for extending the electrical life of the transfer member by maintaining the transfer member at a substantially constant resistivity.

31 Claims, 10 Drawing Sheets

PRINTING MACHINE AND METHOD USING A BIAS TRANSFER ROLLER INCLUDING AT LEAST ONE TEMPERATURE-MAINTAINING DEVICE

BACKGROUND OF THE INVENTION

1. Field of Invention

This application relates to printing machines having a bias transfer roller that transfers a toner image from an intermediate member, such as a belt, to a transfuse member, such as a belt, which then fuses the toner image to a recording medium, such as paper.

2. Description of Related Art

In a buffered belt transfuse system, conventional color toner separations are electrostatically transferred to a relatively thin intermediate belt in a plurality of first transfer nips. The full color image is then electrostatically transferred in a second transfer nip to a hot transfuse member (typically a transfuse belt). The intermediate belt heats up after passage through the second transfer nip. However, prior to the first transfer nip, the temperature of the intermediate belt is cooled and maintained at a stable temperature condition. In this manner, the imaging system is "buffered" from the transfuse heat. The full color image on the transfuse belt is then rheologically transferred to paper in a third transfer nip.

Bias transfer rollers are conventionally used in the second transfer nip due to advantages caused by the addition of mechanical pressure at the second transfer nip. Additionally, the bias transfer rollers aid in reducing the intermediate belt heat thereby enabling shorter dwell time as compared to using corona transfer.

During standby, prior to engagement of the printing process, the bias transfer roller and the intermediate belt are disengaged from the hot transfuse belt in order to prevent reliability and life issues of the intermediate belt and bias transfer roller materials.

Accordingly, at the start of the printing process, the bias transfer roller can take a substantially long time to cycle up to its higher steady state temperature after nip engagement. Initially, the bias transfer roller is engaged in nip forming contact with the hot transfuse belt. This engagement causes the bias transfer roller to heat up. At an extreme start up condition, the bias transfer roller temperature is initially at room temperature and eventually cycles up to a much higher steady state temperature condition. The steady state condition depends on parameters such as the initial intermediate belt temperature, the transfuse belt temperature, the second transfer nip contact dwell time, etc.

With typical 6 mm. thick bias transfer roller rubber layers, the bias transfer roller can take a substantial duration of time to cycle up to the higher steady state temperature after. For example, typically the bias transfer roller will take more than about 20 minutes to cycle up to a steady state value of around 70° C. under typical nip dwell conditions where the initial intermediate belt temperature is maintained at about room temperature and the transfuse belt is maintained at about 120° C. The bias transfer roller temperature swings can even be larger at higher transfuse belt temperatures or longer bias transfer roller nip dwell times. To the disadvantage of conventional transfuse systems, after nip engagement with the transfuse belt, the bias transfer roller moves through a substantially wide temperature swing thereby requiring a substantially long cycle up period.

Bias transfer roller transfer prefers an optimum range of restivities in order to achieve wide operating transfer latitude. Ideally, the bias transfer roller resistivity is maintained over a very narrow range of optimum values in order to achieve stable, optimum transfer performance. Conventional systems can sometimes accept around a 10× variation in resistivity by using constant bias transfer roller current or other power supply control approaches that tend to compensate somewhat for the effects of changing bias transfer roller resistivity. However, usually this requires some transfer latitude help via optimized toner design for transfer and it usually also requires some tradeoff compromise in performance at the extremes of the bias transfer roller resistivity variations. More ideally, the resistivity variation is less than 3× in a system for very robust performance. Unfortunately, the resistivity of conventionally available bias transfer roller materials is significantly dependent on the bias transfer roller temperature. For example, the resistivity of many ionic filled bias transfer rollers can change by more than three orders of magnitude when the temperature changes between about 25° C. and 120° C. The bias transfer roller temperature swings that occur in a transfuse system can thus cause significant bias transfer roller latitude issues for transfuse systems.

Additional bias transfer roller problems caused by exposure to elevated temperatures in the conventional transfuse system exist. For example, some bias transfer roller materials can have increased mechanical degradation problems due to the elevated temperature. Also, long term exposure to the combination of elevated temperature and high transfer electrostatic field cause significant drift in the electrical and mechanical properties of some readily available bias transfer roller materials. For such materials, it is advantageous not to expose the bias transfer roller to elevated temperatures. Since bias transfer roller material development is difficult and generally involves long manufacturing development and qualification cycles in order to meet all of the mechanical, electrical, and life requirements needed for bias transfer rollers, an alternate solution to material processing is desirable.

Furthermore, the electrical properties of various bias transfer roller materials have the tendency to drift with use, even at room temperature. Accordingly, bias transfer roller aging and life issues are evident. For optimum and robust bias transfer roller performance, it is desirable to implement a system that compensates for long term drift in the electrical properties of the bias transfer roller.

U.S. Pat. No. 6,088,565 to Jia et al., the entire disclosure of which is incorporated herein by reference, discloses a conventional transfuse system in which plural toner image forming stations form toner images on an intermediate transfer member, and then the composite toner image is transferred to a transfuse member at a second transfer nip. Jia et al. does not disclose controlling, or recognize the need to control, the bias transfer roller temperature.

U.S. Pat. No. 5,321,476 to Gross, the entire disclosure of which is incorporated herein by reference, discloses a bias transfer roller including an internal heating element. The Gross system is not a transfuse system; rather, Gross uses a bias transfer roller to directly transfer a toner image to a sheet of paper. Since the toner image is fused to the paper at a separate location, the bias transfer roller is not subjected to heat from the fuser. In addition, Gross does not disclose controlling the bias transfer roller temperature by using an external temperature control device.

SUMMARY OF THE INVENTION

This invention has been made in view of the above circumstances. The present invention addresses the long-standing problems discussed above by controlling the temperature of the bias transfer roller in a transfuse system during standby and/or after nip engagement in order to provide and maintain optimum transfuse system bias transfer roller resistivity ranges in a transfuse system.

One aspect of this invention is to control the temperature of the transfuse system bias transfer roller by cooling the bias transfer roller to avoid excessive bias transfer roller heating and to maintain the bias transfer roller within an optimum temperature range.

Another aspect of this invention is to provide temperature control to the transfuse system bias transfer roller by heating the bias transfer roller, e.g., during standby, thereby avoiding long term cycle up changes after nip engagement.

In accordance with another aspect of this invention, a control system is provided that compensates for possible long term drift of the bias transfer roller electrical properties by periodically updating the temperature control setting of the bias transfer roller. The control system monitors the bias transfer roller voltage needed for a given bias transfer roller current and chooses an updated bias transfer roller temperature control setpoint.

BRIEF DESCRIPTION OF THE DRAWINGS

The invention will be described with reference to the following drawings in which like reference numerals refer to like elements, and wherein.

DETAILED DESCRIPTION OF PREFERRED EMBODIMENTS

Briefly, in accordance with the present invention, there is disclosed one example of a conventional printing machine that can be modified to include a bias transfer roller of the invention, arranged with at least one temperature-maintaining device.

Figure 1:
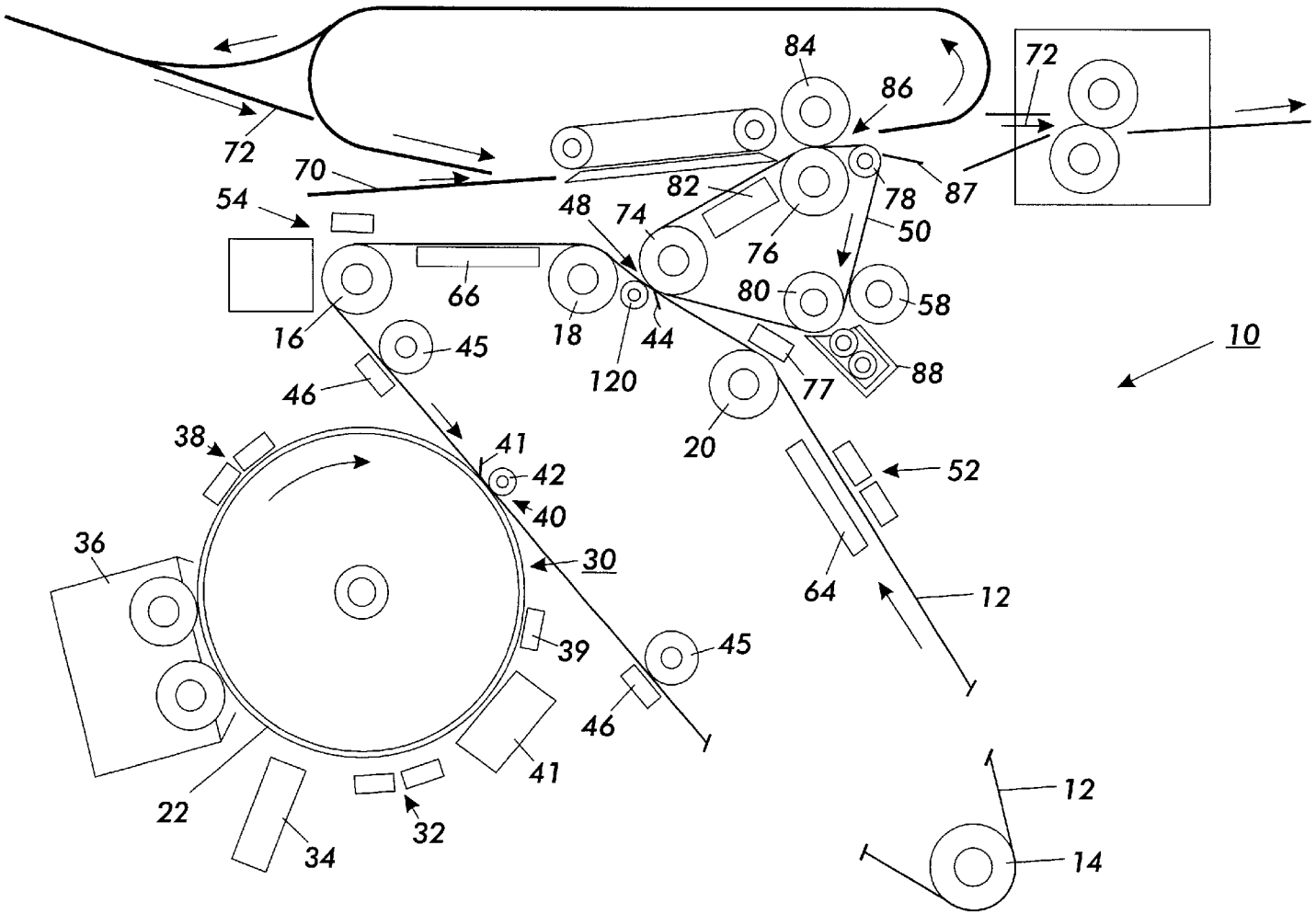
FIG. 1 PRIOR ART
FIG. 1 illustrates a schematic view of a conventional printing machine including a bias transfer roller.

FIG. 1 shows a conventional printing machine having an intermediate transfer belt 12 (or intermediate transfer member). The intermediate transfer belt 12 is driven over guide rollers 14, 16, 18, and 20. The intermediate transfer belt 12 moves in a process direction shown by the arrows. For purposes of discussion, a section of the intermediate transfer member 12 on which an image is formed will be referred to as a toner area.

The toner area is moved past at least one toner image producing station 22. The printing machine can have one or a plurality of toner image stations, and can produce mono-toner or color images. However, for simplicity, an exemplary printing machine having only one toner image station is described herein. The toner image station 22 operates to place a toner image on the toner area of the intermediate transfer member 12. The toner image station 22 has an image bearing member 30. The image bearing member 30 is a drum or belt supporting a photoreceptor.

The image bearing member 30 is uniformly charged at a charging station 32. An exposure station 34 exposes the charged image bearing member 30 in an image-wise fashion to form an electrostatic latent image at the image area. For purposes of discussion, the image bearing member defines an image area.

The image area is advanced to a development station 36. The development station 36 has a developer (e.g., a toner) corresponding to the color component of the composite color image if a color image is to be formed. The developer station 36 preferably develops the latent image with a charged dry toner powder to form the developed component toner image. The image area having the component toner image then advances to the pretransfer station 38.

The pretransfer station 38 preferably has a pretransfer charging device to charge the component toner image and to achieve some leveling of the surface voltage above the image bearing member 30 to improve transfer of the component image from the image bearing member 30 to the intermediate transfer member 12.

The image area then advances to a first transfer nip 40 defined between the image bearing member 30 and the intermediate transfer member 12. The image bearing member 30 and intermediate transfer member 12 are synchronized such that each has substantially the same linear velocity at the first transfer nip 40. The component toner image is electrostatically transferred from the image bearing member 30 to the intermediate transfer member 12 by use of a field generation station 42.

The field generation station 42 is preferably a bias transfer roller 42 that is electrically biased to create sufficient electrostatic fields of a polarity opposite that of the component toner image to thereby transfer the component toner image to the intermediate transfer member 12. Alternatively the field generation station 42 can be a corona device, a bias transfer roller or some other type of field generation system known in the art. A prenip transfer blade 41 mechanically biases the intermediate transfer member 12 against the image bearing member 30 for improved transfer of the component toner image. The toner area of the intermediate transfer member 12 having the component toner image from the toner image producing station 22 then advances in the process direction.

After transfer of the component toner image, the image bearing member 30 then continues to move the image area past a preclean station 39. The preclean station employs a pre clean corotron to condition the toner charge and the charge of the image bearing member 30 to enable improved cleaning of the image area. The image area then further advances to a cleaning station 141. The cleaning station 141 removes the residual toner or debris from the image area. The operation of the cleaning station 141 completes the toner image production for the toner image station 22.

The component toner image is advanced from the first transfer nip 40 of the toner image station 22 around a guide roller 14 that is preferably adjustable for tensioning the intermediate transfer member 12 into and out of a cammed and an uncammed position.

The intermediate transfer member 12 transports the composite toner image through a pre-transfer charge conditioning station 52 and to a second transfer nip 48 defined between the intermediate transfer member 12 and the transfuse member 50. A bias transfer roller 120 (or first transfer member) and pre-transfer nip blade 44 engage the intermediate transfer member 12 adjacent the second transfer nip 48 and perform similar functions as the bias transfer roller 42 and pre-transfer blade 41 adjacent the transfer nip 40. However the bias transfer roller 120 at the second transfer nip 48 can be relatively harder to engage conformable transfuse member 50. The composite toner image is transferred electrostatically and with heat assist to the transfuse member 50. Heat assist is provided by the heating station 82.

The electrical characteristics of the intermediate transfer member 12 are also important. The intermediate transfer member 12 can optionally be constructed of a single layer or multiple layers. In any case, preferably the electrical properties of the intermediate transfer member 12 are selected to reduce high voltage drops across the intermediate transfer member. To reduce high voltage drops, the resistivity of the back layer of the intermediate transfer member 12 preferably has sufficiently low resistivity. The electrical characteristics and the transfer geometry should also be chosen to prevent high electrostatic transfer fields in pre-nip regions of the first and second transfer nips 40, 48. High pre-nip fields at air gaps of around typically >50 microns between the component toner images and the intermediate transfer member 12 can lead to image distortion due to toner transfer across an air gap and can also lead to image defects caused by pre-nip air breakdown. This can be avoided by bringing the intermediate transfer member 12 into early contact with the component toner image prior to the bias transfer roller 120, as long as the resistivity of any of the layers of the intermediate transfer member 12 are sufficiently high. The intermediate transfer member 12 also should have sufficiently high resistivity for the topmost layer to prevent very high current flow from occurring in the first and second transfer nips 40, 48. Finally, the intermediate transfer member 12 and the system design preferably minimizes the effect of high and/or non-uniform charge buildup that can occur on the intermediate transfer member 12 between the first transfer nips 40. For more details on the intermediate transfer member, see for example, the above-incorporated U.S. Pat. No. 6,088,565.

Discussion below will specify the preferred range of electrical properties for the transfuse member 50 to allow good transfer in the second transfer nip 48. The transfuse member 50 will preferably have multiple layers and the electrical properties chosen for the topmost layer of the transfuse member 50 will influence the preferred resistivity for the intermediate transfer member 12. The lower limits for the preferred resistivity of the intermediate transfer member 12 apply if the top most surface layer of the transfuse member 50 has a sufficiently high resistivity. If the top most surface layer of the transfuse member 50 has a somewhat lower resistivity, the lower limit for the preferred resistivity of the intermediate transfer member 12 should be increased in order to avoid transfer problems in the second transfer nip 48. Such problems include undesirably high current flow between the intermediate transfer member 12 and the transfuse member 50, and transfer degradation due to reduction of the transfer field.

Transfer of the composite toner image in the second transfer nip 48 is accomplished by a combination of electrostatic and heat assisted transfer. The bias transfer roller 120 and guide roller 74 are electrically biased to electrostatically transfer the charged composite toner image from the intermediate transfer member 12 to the transfuse member 50.

The transfer of the composite toner image at the second transfer nip 48 can be heat assisted (e.g., by heating station 82 or the guide rollers 74, 76) such that the temperature of the transfuse member 50 is maintained at a sufficiently high optimized level and the temperature of the intermediate transfer member 12 is maintained at a considerably lower optimized level prior to the second transfer nip 48. The mechanism for heat assisted transfer is thought to be softening of the composite toner image during the dwell time of contact of the toner in the second transfer nip 48. The toner softening occurs due to contact with the higher temperature transfuse member 50. This composite toner softening results in increased adhesion of the composite toner image toward the transfuse member 50 at the interface between the composite toner image and the transfuse member. This also results in increased cohesion of the layered toner pile of the composite toner image. The temperature on the intermediate transfer member 12 prior to the second transfer nip 48 needs to be sufficiently low to avoid too high a toner softening and too high a resultant adhesion of the toner to the intermediate transfer member 12. The temperature of the transfuse member 50 should be considerably higher than the toner softening point prior to the second transfer nip to insure optimum heat assist in the second transfer nip 48. Further, the temperature of the intermediate transfer member 12 just prior to the second transfer nip 48 should be considerably lower than the temperature of the transfuse member 50 for optimum transfer in the second transfer nip 48.

The transfuse member 50 is guided in a cyclical path by guide rollers 74, 76, 78, 80. Guide rollers 74, 76 alone or together are preferably heated to thereby heat the transfuse member 50. The intermediate transfer member 12 and transfuse member 50 are preferably synchronized to have generally the same velocity in the transfer nip 48. The transfuse member 50 and a pressure roller 84 define a third transfer nip 86 therebetween.

A releasing agent applicator 88 applies a controlled quantity of a releasing material, such as a silicone oil to the surface of the transfuse member 50. The releasing agent serves to assist in release of the composite toner image from the transfuse member 50 in the third transfer nip 86.

The transfuse member 50 is preferably constructed of multiple layers. The transfuse member 50 must have appropriate electrical properties for being able to generate high electrostatic fields in the second transfer nip 48. To avoid the need for unacceptably high voltages, the transfuse member 50 preferably has electrical properties that enable sufficiently low voltage drop across the transfuse member 50 in the second transfer nip 48. In addition the transfuse member 50 will preferably ensure acceptably low current flow between the intermediate transfer member 12 and the transfuse member 50. The requirements for the transfuse member 50 depend on the chosen properties of the intermediate transfer member 12. In other words, the transfuse member 50 and intermediate transfer member 12 together have sufficiently high resistance in the second transfer nip 48.

The transfuse member 50 will preferably have a laterally stiff back layer, a thick, conformable rubber intermediate layer, and a thin outermost layer. The back and intermediate layers need to have sufficiently low resistivity to prevent the need for unacceptably high voltage requirements in the second transfer zone 48. The preferred resistivity condition follows previous discussions given for the intermediate transfer member 12.

The composite toner image is transferred and fused to the substrate 70 (e.g., paper) in the third transfer nip 86 to form a completed document 72. Heat in the third transfer nip 86 from the substrate 70 and transfuse member 50, in combination with pressure applied by the pressure roller 84 acting against the guide roller 76 transfer and fuse the composite toner image to the substrate 70 to form a final document.

Other embodiments of the printing apparatus are well known to one of ordinary skill in the art and are also within the scope of this invention.

One object of the present invention is to control the temperature of the bias transfer roller 120 during standby and/or after engagement to optimize the resistivity ranges of the bias transfer roller in the transfuse system.

Figure 2:
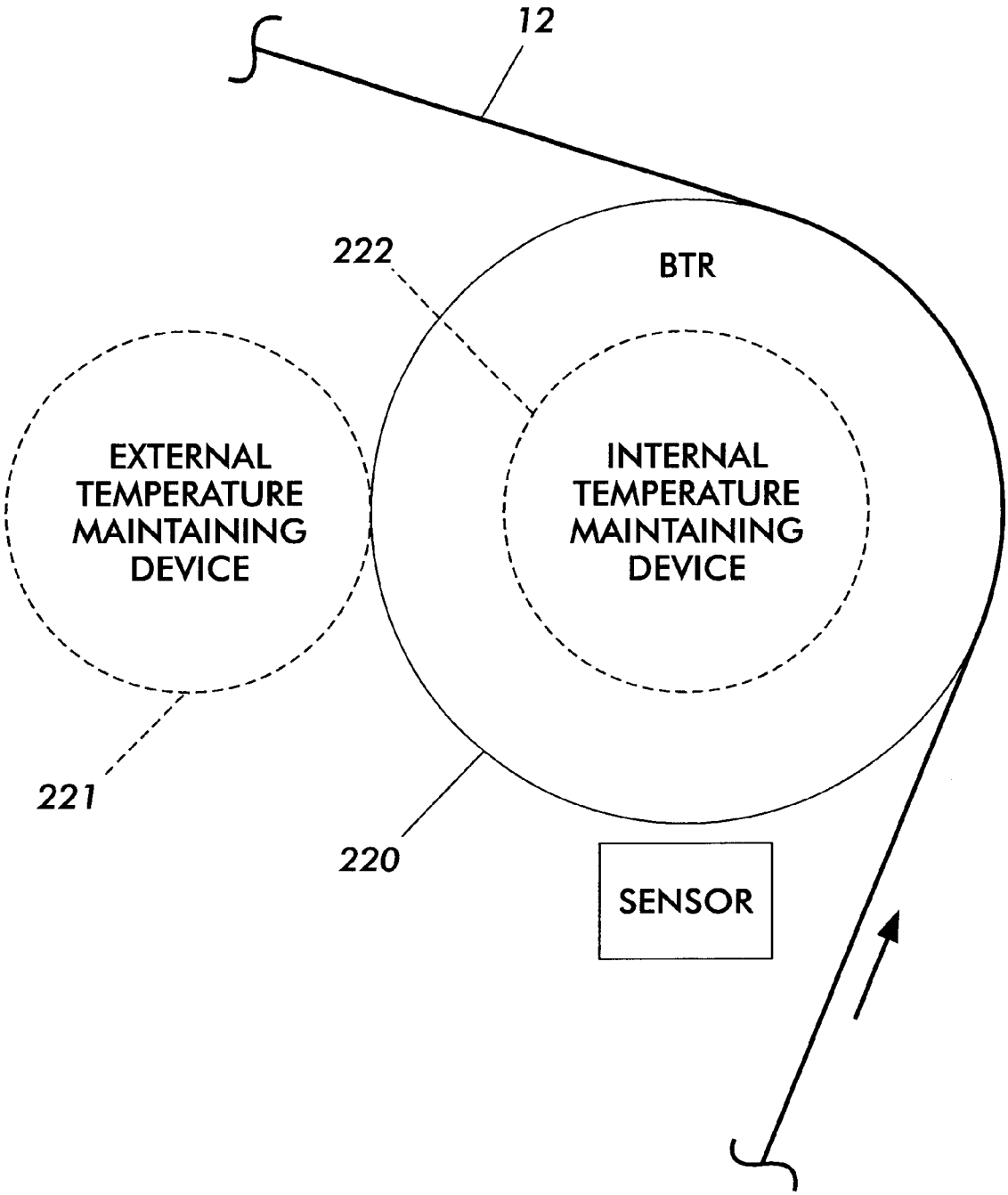
FIG. 2 illustrates one embodiment of a bias transfer roller having an internal temperature-maintaining device and an external temperature-maintaining device.

FIG. 2 shows one embodiment for the bias transfer roller 220 of FIG. 1, having at least one temperature-maintaining device 221, 222 (or temperature control device) in accordance with the present invention.

In this embodiment, the temperature-maintaining device may comprise only an external temperature-maintaining device 221. In a further embodiment, the temperature-maintaining device may comprise only an internal temperature-maintaining device 222. In a further embodiment, the temperature-maintaining device may comprise both an external temperature-maintaining device 221 and an internal temperature-maintaining device 222.

Figure 9:
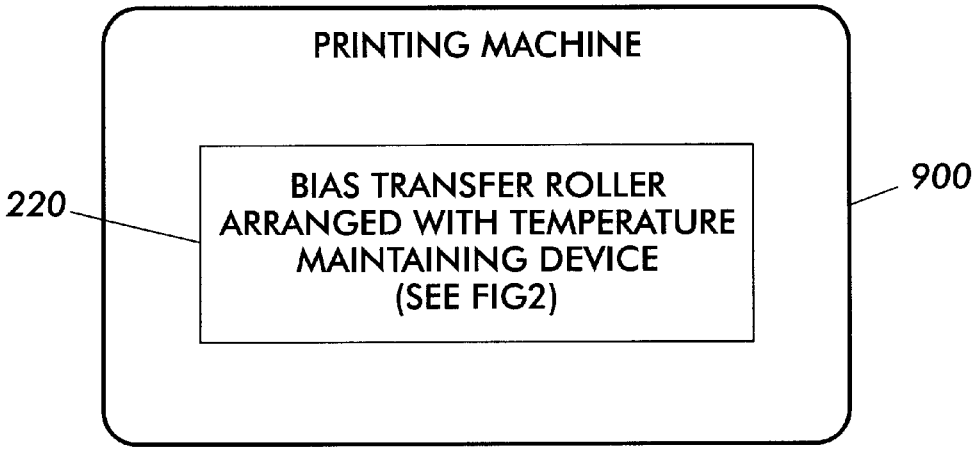
FIG. 9 illustrates a printing machine including the bias transfer roller temperature-maintaining device of FIG. 2.

FIG. 9 shows a printing machine 900 including the bias transfer roller arranged with the temperature-maintaining device 200 as shown in the embodiment of FIG. 2 and in accordance with the present invention. The machine can, for example, have the structure of FIG. 1, except that the bias transfer roller 220 and temperature-maintaining device(s) of FIG. 2 are substituted for the bias transfer roller 120 of FIG. 1. The printing machine 900 can be, for example, a single- or multi-color copier, printer, facsimile machine, etc.

In order to provide temperature control of the bias transfer roller temperature during nip engagement, and to thereby provide an optimum bias transfer roller resistivity range in a transfuse system, the bias transfer roller 220 is cooled.

Figure 3:
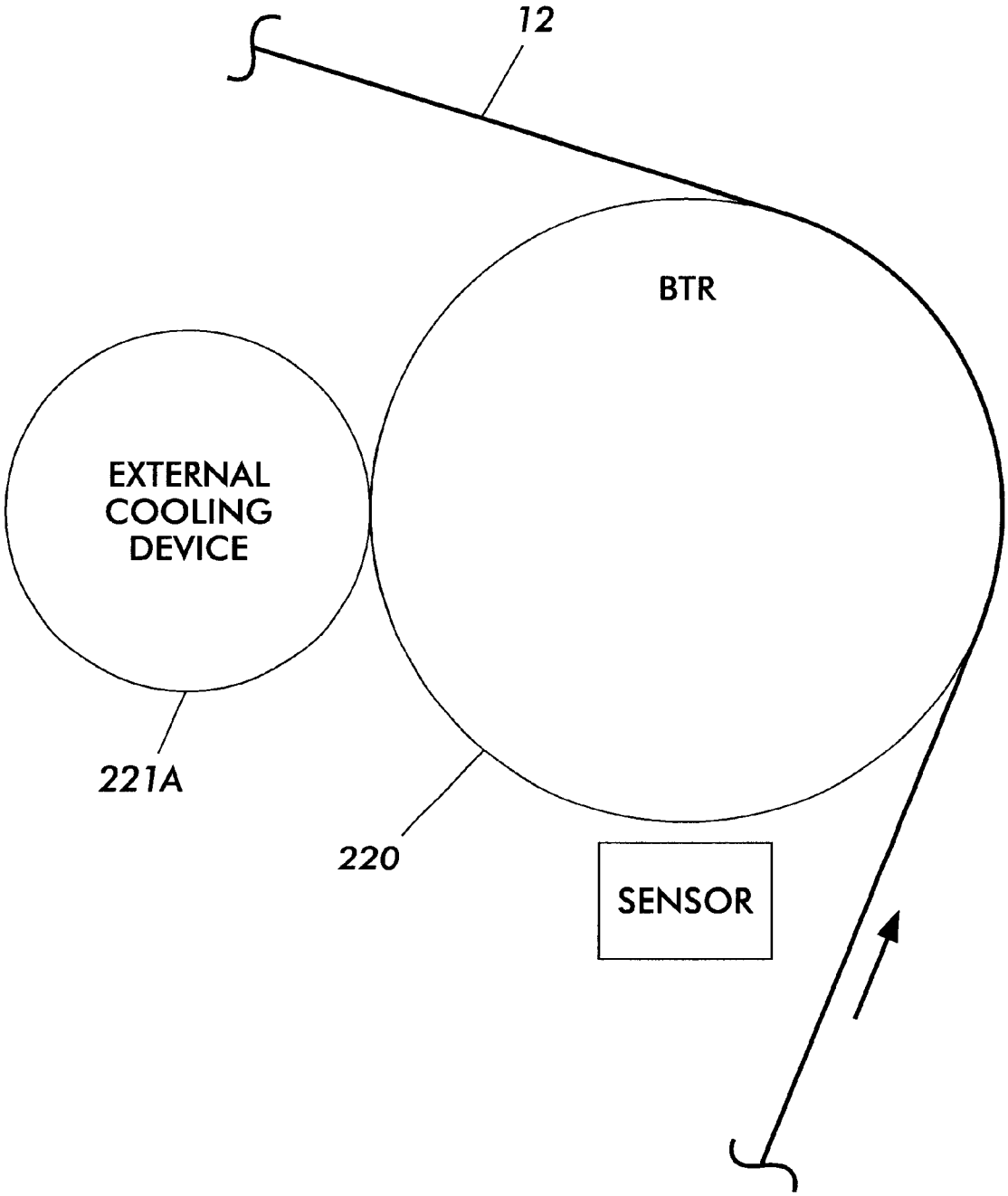
FIG. 3 illustrates a bias transfer roller with the external temperature-maintaining device being an external cooling device.
Figure 5:
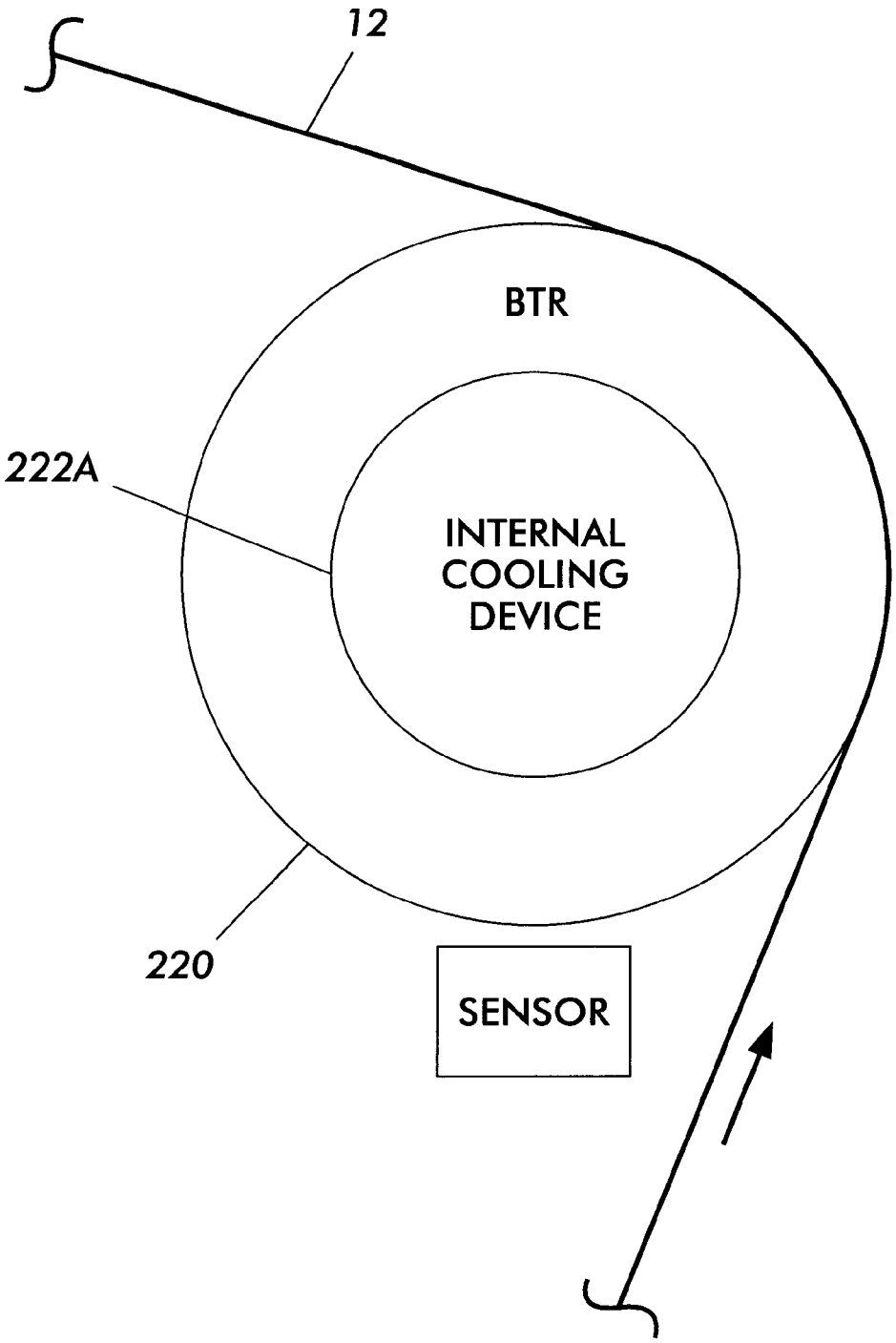
FIG. 5 illustrates a bias transfer roller with the internal temperature-maintaining device being an internal cooling device.
Figure 7:
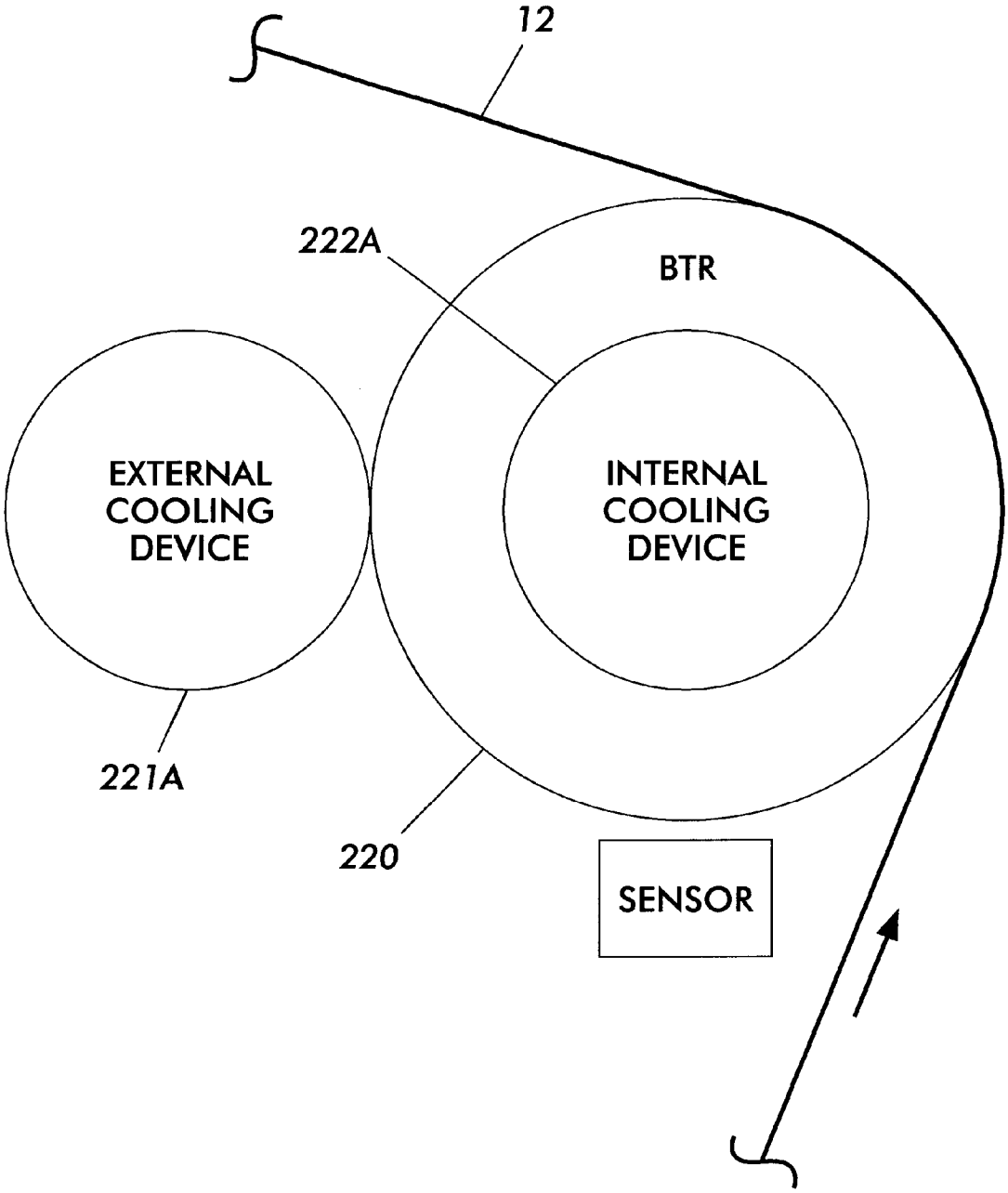
FIG. 7 illustrates a bias transfer roller with an internal temperature-maintaining device being an internal cooling device and an external temperature-maintaining device being an external cooling device.

FIGS. 3, 5 and 7 illustrate cooling of the bias transfer roller 220 during nip contact engagement with the transfuse belt 5. By cooling the bias transfer roller 220 during nip engagement, substantial excess heating of the bias transfer roller 220 and thus instability of resistivity is avoided. Generally, no heating of the bias transfer roller 220 is needed in this nip engagement mode. However, heating may be desirable to further refine the control of the temperature of the bias transfer roller 220 during cycling.

An optimum bias transfer roller resistivity condition at the controlled temperature condition should be chosen. Generally, the optimum resistivity to be chosen is a resistivity such that the nip charge relaxation time is within about a factor of approximately 2 of the nip dwell time so that post nip fields are larger than pre-nip fields. Cooling of the bias transfer roller 220 prevents the above described disadvantages of cycle-up and also substantially relieves problems associated with "hot bias transfer rollers" in transfuse systems.

Surface cooling of the bias transfer roller 220, as shown in FIGS. 3 and 7, is preferred compared to central cooling, as shown in FIG. 5. By providing surface cooling, temperature gradients, which might occur due to heating of the bias transfer roller 220 in the transfuse nip are avoided.

Cooling can be achieved in many ways; such as via bias transfer roller nip forming contact with a controlled temperature surface, e.g., by a fluid, a cooling belt, an air cooler, a fan, a coolant, a heat exchanger or another cooling roller.

Since the bias transfer roller 220 operates at a high voltage, surface contact between the bias transfer roller 220 and the cooling device must be performed in a manner that avoids current flow to the cooling device. For example, if a surface contacting roller is used as the cooling temperature-maintaining device, the surface contacting roller could have a sufficiently electrically insulating coating layer. Alternatively, the surface contacting roller can be maintained at the potential of the bias transfer roller 220.

FIG. 3 illustrates a first embodiment of the temperature-maintaining device. In this embodiment, the temperature-maintaining device is an external temperature-maintaining device 221, as generally shown in FIG. 2. The external temperature-maintaining device 221 is an external cooling device 221A that provides surface cooling to the bias transfer roller 220.

FIG. 5 illustrates a second embodiment of the temperature-maintaining device. In this second embodiment, the temperature-maintaining device is an internal temperature-maintaining device 222, as generally shown in FIG. 2. The internal temperature-maintaining device 222 is an internal cooling device 222A that provides cooling to the bias transfer roller 220.

FIG. 7 illustrates a third embodiment of the temperature-maintaining device. In this embodiment, bias transfer roller 220 includes both an external temperature-maintaining device 221 and an internal temperature-maintaining device 222, as generally shown in FIG. 2. In particular, the external temperature-maintaining device 221 is an external cooling device 221A and the internal temperature-maintaining device 222 is an internal cooling device 222A. Both, the external cooling device 221A and the internal cooling device 222A are capable of providing cooling to the bias transfer roller 220.

In order to provide temperature control of the bias transfer roller temperature during standby, i.e., prior to nip engagement, and to thereby provide an optimum bias transfer roller resistivity range in a transfuse system upon nip engagement, the bias transfer roller 220 is heated.

Figure 4:
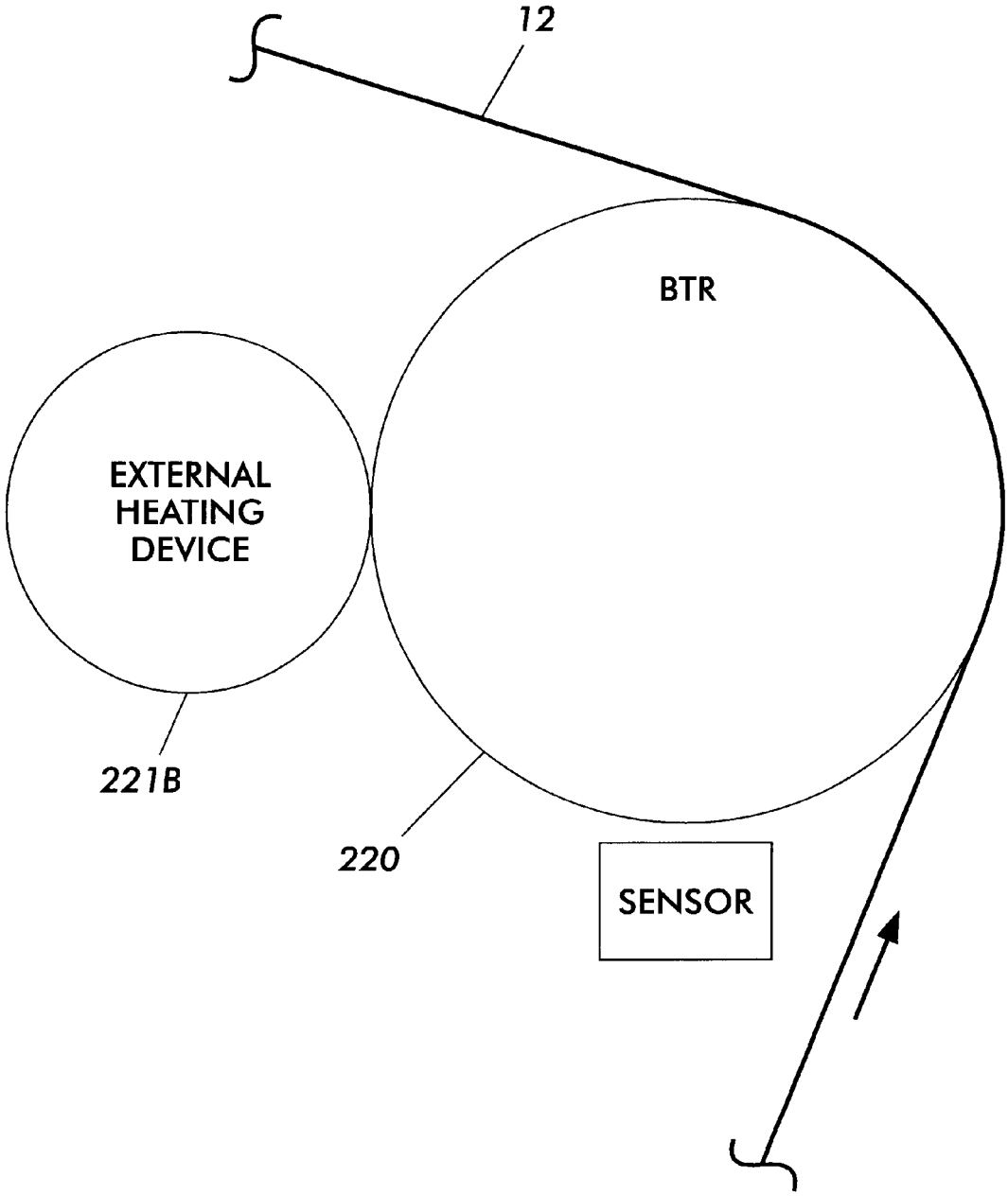
FIG. 4 illustrates a bias transfer roller with the external temperature-maintaining device being an external heating device.
Figure 6:
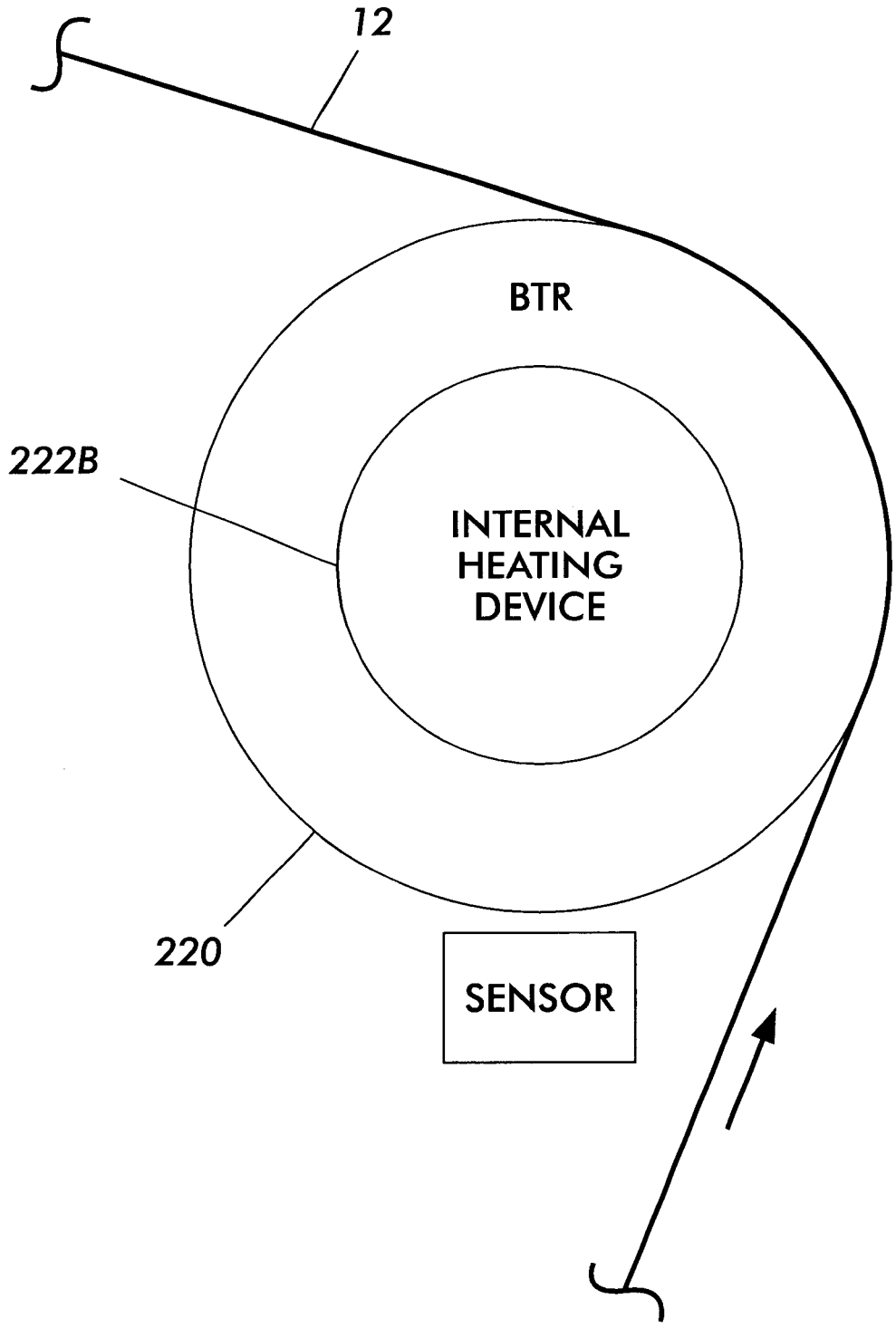
FIG. 6 illustrates a bias transfer roller with the internal temperature-maintaining device being an internal heating device.
Figure 8:
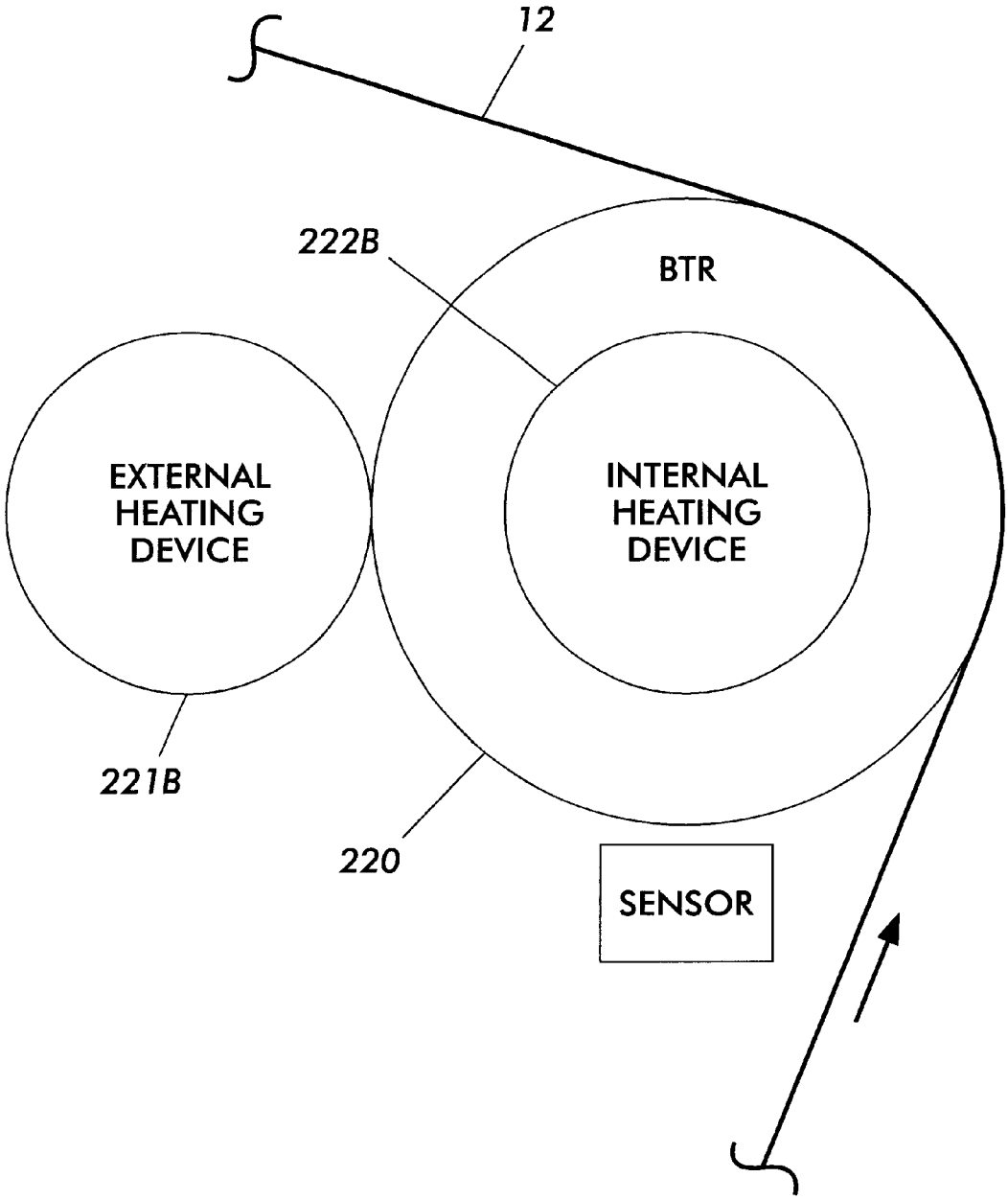
FIG. 8 illustrates a bias transfer roller with an external temperature-maintaining device being an external heating device and an internal temperature-maintaining device being an internal heating device.

FIGS. 4, 6 and 8 illustrate controlling the temperature of the bias transfer roller 220 by heating the bias transfer roller 220 during standby, i.e., prior to nip engagement, to avoid long term cycle up temperature changes after nip engagement with the transfuse belt 5.

By providing control of, and heat to, the bias transfer roller 220 during cam-away standby, the bias transfer roller 220 can be maintained at substantially the same temperature value (steady state temperature) that would occur after long term engagement of the bias transfer roller 220 with the hot transfuse belt 50. Generally, no cooling of the bias transfer roller 220 is necessary in this standby mode. However, cooling may be desirable to further refine the control of the temperature of the bias transfer roller 220 during nip contact cycling.

An optimum bias transfer roller resistivity condition at the elevated temperature condition should be chosen. Standby heating temperature control of the bias transfer roller 220 eliminates the excessive bias transfer roller resistivity swings that would otherwise occur over a long cycle up time after nip engagement. Heating of the bias transfer roller 220 is appropriate for bias transfer roller materials that do not have mechanical or long-term resistivity life problems due to long-term operation at elevated temperatures. During standby, heating of the bias transfer roller 220 can be performed by internal and/or external heating temperature-maintaining devices.

Heating can be achieved in various ways; such as via bias transfer roller nip forming contact with a controlled temperature surface, e.g., by a resistant heater, a heat coil, a heating lamp, heated fluid, an air heater, heated air circulation, a heat exchanger or heated roller.

FIG. 4 further illustrates another aspect of the temperature-maintaining device. In this embodiment, the temperature-maintaining device is an external temperature-maintaining device 221, as generally shown in FIG. 2. The external temperature-maintaining device 221 is an external heating device 221B that provides surface heating to the bias transfer roller 220.

FIG. 6 further illustrates another aspect of the temperature-maintaining device. In this second embodiment, the temperature-maintaining device is an internal temperature-maintaining device 222, as generally shown in FIG. 2. The internal temperature-maintaining device 222 is an internal heating device 222B that provides heating to the bias transfer roller 220.

FIG. 8 illustrates another aspect of the temperature-maintaining device. In this embodiment, bias transfer roller 220 includes both an external temperature-maintaining device 221 and an internal temperature-maintaining device 222, as generally shown in FIG. 2. In particular, the external temperature-maintaining device 221 is an external heating device 221B and the internal temperature-maintaining device 222 is an internal heating device 222B. Both the external heating device 221B and the internal heating device 222B are capable of providing heat to the bias transfer roller 220.

Figure 10:
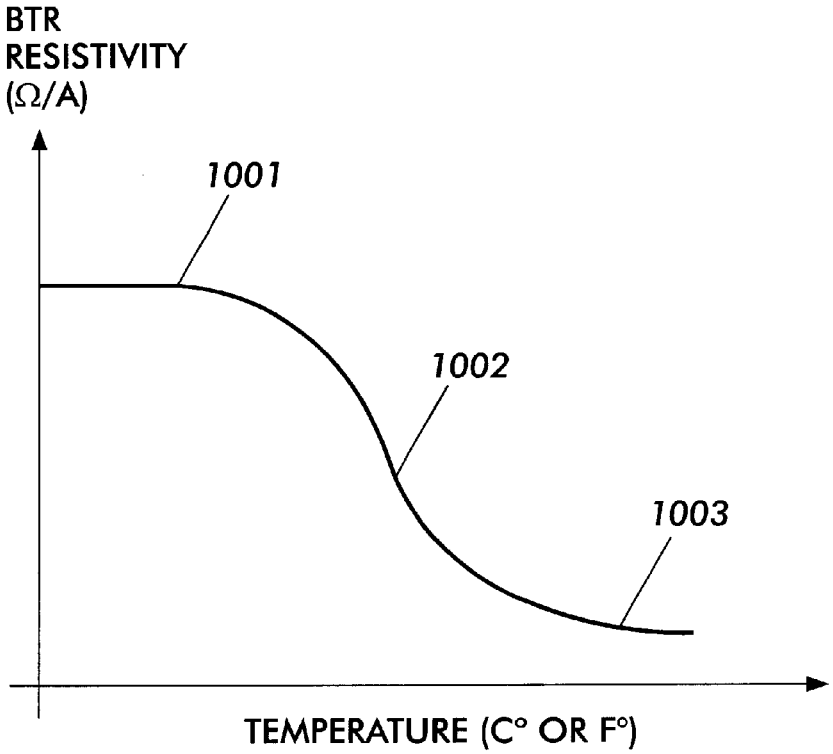
FIG. 10 is a graph depicting the relationship of bias transfer roller resistivity versus bias transfer roller temperature.

FIG. 10 is a graph depicting the relationship of bias transfer roller resistivity (measured in Ohms per unit area) versus bias transfer roller temperature (measured in degrees Celsius or Fahrenheit). According to the present invention, as the temperature of the bias transfer roller (BTR) is increased. The resistivity of the bias transfer roller 120 is decreased.

For optimum bias transfer roller operating latitude, the resistivity of the bias transfer roller is ideally maintained within a narrow, stable optimum regime of values. However, the resistivity of typical bias transfer roller materials is sensitive to temperature, and the bias transfer roller temperature in a transfuse system can significantly change (cycle up) after bias transfer roller nip engagement with the hot transfuse member.

Figure 11:
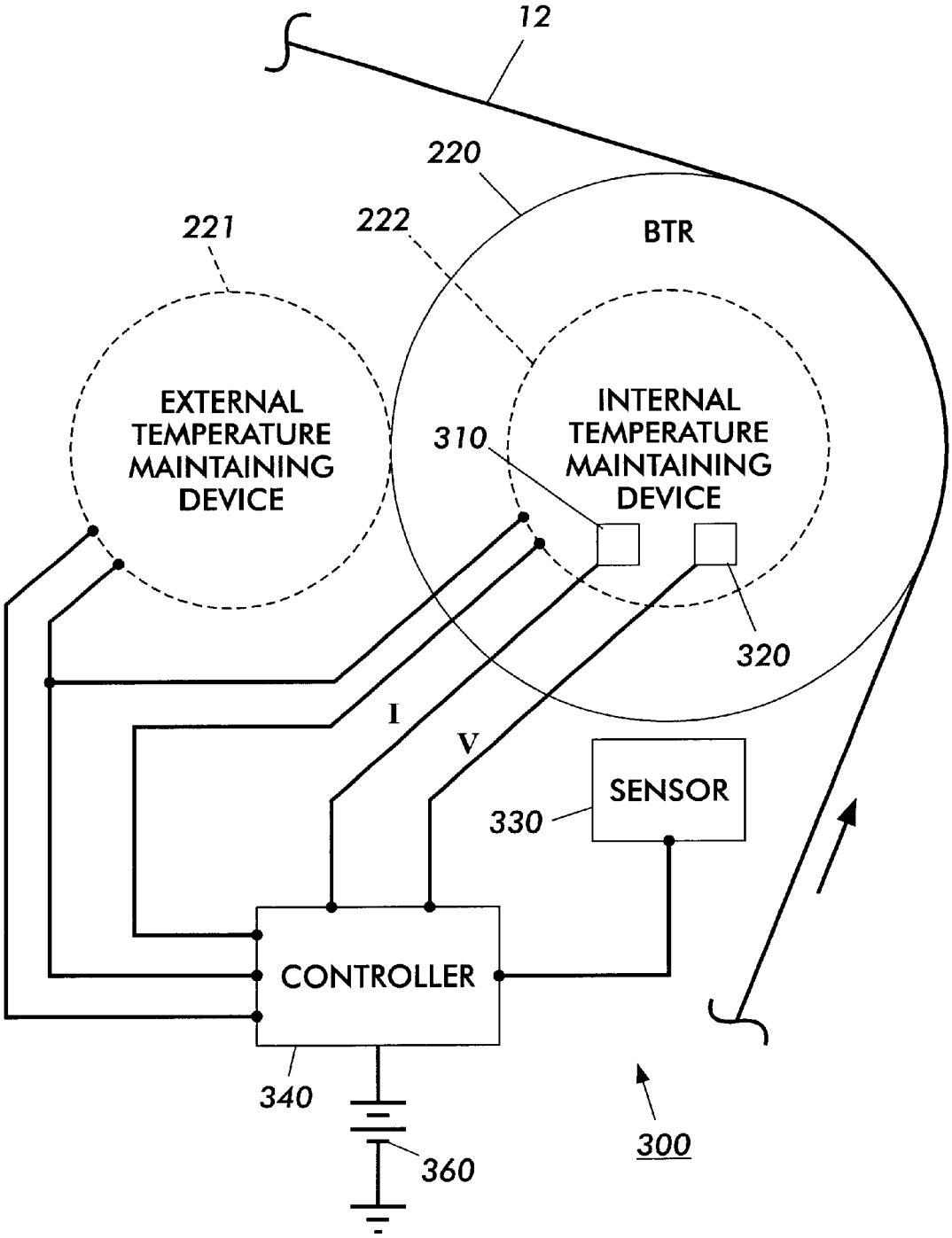
FIG. 11 illustrates a control assembly connected to a bias transfer roller having an internal temperature-maintaining device and an external temperature-maintaining device.

FIG. 11 illustrates a fourth embodiment of the temperature-maintaining device. FIG. 11 depicts a control assembly 300, integrated with any of the previously mentioned embodiments. The control assembly 300 compensates for possible drift in the electrical properties of the bias transfer roller 220 which may be due to, for example, aging effects. The bias transfer roller voltage needed to create a given bias transfer roller current is related to the electrical properties of the bias transfer roller. Therefore, sensing of the bias transfer roller voltage for a given bias transfer roller current can be used to determine if drift in the properties of the bias transfer roller has occurred.

The object of this embodiment is to periodically check the bias transfer roller current, voltage and temperature and determine if slight shifts in the temperature control setting of the bias transfer roller 220 are appropriate in order to maintain a substantially constant operating voltage for the given operating bias transfer roller current. By correcting for shifts (via new bias transfer roller temperature conditions), the bias transfer roller electrical properties can be monitored and restored back to the near original bias transfer roller resistivity levels for maintaining optimum transfer conditions in spite of long term drift in the bias transfer roller properties. Generally, this embodiment may utilize both heating and cooling for the bias transfer roller temperature control. For example, external device 221 preferably is a cooling device, while internal device 222 is a heating device. The opposite arrangement also is possible.

The functional life of the bias transfer roller 220 is directly related to the maintenance of a constant controlled resistivity region. However, most ionic additives utilized for reducing the resistivity in polymer materials used in bias transfer roller members migrate toward higher potential energy, causing an increase in ionic mobility, which therefore results in a more rapid variation in resistivity over the life of the material. It is known that the electrical life of materials used in bias transfer devices and subsystems as described above can be improved by controlling and maintaining constant resistivity with time under an applied electrical field. It is also known that the resistivity of a material is directly related to the temperature thereof. Thus, the electrical life of a bias transfer member can be improved by selectively controlling the temperature of the bias transfer member for maintaining the temperature thereof at a predetermined elevated temperature. Variation of the temperature of the bias transfer roller allows for control of the resistivity thereof. For this reason, the present invention provides a controller assembly including a controller 340 connected to at least one of the temperature-maintaining devices 221, 222 for controlling the temperature thereof.

The significance of controlling the temperature is that the temperature-maintaining device provides the capability to control the resistivity of the bias roller 220 to compensate for changes in the electrical parameters of the roller and its environment. The parameter that normally experiences the greatest and most frequent fluctuations is the roller resistivity, which is very sensitive to relative humidity (RH), and temperature. One object of the present invention is to control the temperature and to keep the applied field below Paschen's limit as described in detail in the above-incorporated U.S. Pat. No. 5,321,476, to prevent pre-nip ionization. Moreover, since bias transfer roller electrical life is a function of the applied field and therefore the voltage across the bias transfer roller, maintenance of a constant, lower resistivity extends the electrical life of the roller.

The current referred to as being held constant throughout this description is the current to the bias transfer roller core. This bias transfer roller current is, by reason of conservation of charge, basically equal to the post-nip ionization current. (Substantially zero pre-nip current is, of course, one of the desired operating conditions here.) The controller 340 controls by automatically widely varying the potential level coupled to bias transfer roller 220 to automatically compensate for variation in current to the bias transfer roller 220, due to the connected load (resistance) changes, which are due to changes in ambient RH and temperature and aging of materials as well as various other factors tending to effect the pre-nip, nip and post-nip field levels (e.g., paper thickness, charge build-up on the self-leveling layer, etc.).

Referring further to FIG. 11, the temperature-maintaining devices 221, 222 are coupled to a voltage source 360 through a controller 340. Voltage is applied by the voltage source 360 under the control of the controller 340. Sensors 310, 320 and 330 detect a current, a voltage and a temperature. The controller 340 receives and processes the signals and generates an output signal. The output signal may be applied to the internal and external temperature-maintaining devices in a number of ways. The controller 340 can selectively activate one of the temperature-maintaining devices without causing the other to be operational. Alternatively, the controller 340 can cause both of the temperature-maintaining devices 221, 222 to operate simultaneously. As such, optimum control of the resistivity at a predetermined level can be achieved in response to the detected operating conditions of the bias transfer roller.

The voltage sensor can be selectively activated in response to a predetermined resistivity measurement at the bias transfer member. For example, a voltmeter can be provided for monitoring the voltage across a constant current source for maintaining a predetermined constant current through the bias transfer roller 220. When the measured voltage exceeds a predetermined voltage level corresponding to a defined resistivity level, at least one of the temperature-maintaining devices 221, 222 can be activated.

In summary, an electrophotographic printing apparatus of an embodiment of the present invention can be a printing machine having a bias transfer roller including a control assembly 300 for controlling the temperature-maintaining devices 221, 222 in order to control the temperature of the bias transfer roller 220 at a predetermined temperature to reduce and maintain the resistivity of the bias transfer roller 220. By controlling the bias transfer roller 220 temperature, the electrical life of the bias transfer roller 220 is extended.

In the illustrated embodiment, the controller 340 is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A printing apparatus comprising:

a transfuse member;

an intermediate transfer member;

a first transfer member that electrostatically transfers a toner image from the intermediate transfer member to the transfuse member; and a controller, wherein the first transfer member includes at least one temperature control device controlled by the controller to independently maintain the first transfer member within a predefined range.

2. The printing apparatus of claim 1, wherein the at least one temperature control device comprises:

an external temperature control device located adjacent and substantially external to the first transfer member.

3. The printing apparatus of claim 2, wherein the external temperature control device is an external heating device that heats the first transfer member.

4. The printing apparatus of claim 3, wherein the external heating device is at least one of a heating roller and an air heater.

5. The printing apparatus of claim 3, wherein the external heating device is a heating lamp.

6. The printing apparatus of claim 1, wherein the at least one temperature control device comprises an internal temperature control device that is located inside the first transfer member.

7. The printing apparatus of claim 6, wherein the internal temperature control device comprises:

an internal heating device that heats the first transfer member.

8. The printing apparatus of claim 7, wherein the internal heating device is at least one of a heating lamp and a resistive heating coil.

9. The printing apparatus of claim 7, wherein the temperature control device further includes:

an external temperature control device located adjacent and substantially external to the first transfer member, the external temperature control device is an external heating device that heats the first transfer member.

10. The printing apparatus of claim 9, wherein the internal heating device is at least one of a heating lamp and a resistive heating coil.

11. The printing apparatus of claim 9, wherein the external heating device is at least one of a heating roller, air heater and heating lamp.

12. The printing apparatus of claim 1, further comprising:

a control system including the controller connected to the at least one temperature control device that maintains the first transfer member at a substantially constant resistivity by controlling the temperature of the first transfer member, thereby extending the electrical life of the first transfer member.

13. The printing apparatus of claim 12, wherein the control system comprises:

a voltage detector that detects the voltage of the first transfer member for a given current supplied to the first transfer member, the at least one temperature control device being responsive to the detected temperature.

14. The printing apparatus of claim 12, wherein the control system comprises:

a temperature detector that detects the temperature of the first transfer member, the at least one temperature control device being responsive to the detected temperature.

15. The printing apparatus of claim 12, wherein the control system comprises:

a current detector that detects the current through the first transfer member, the at least one temperature control device being responsive to the detected current thereby providing a predetermined current through the first transfer member to generate electric fields between the intermediate transfer member and the first transfer member.

16. The printing apparatus of claim 1, wherein:

the transfuse member is a transfuse belt;

the intermediate member is an intermediate transfer belt; and the first transfer member is a bias transfer roller located within the intermediate belt at a location where external surfaces of the intermediate belt and the transfuse belt contact each other.

17. A method of controlling a temperature of a first transfer member that assists in electrostatically transferring a toner image from an intermediate transfer member to a transfuse member in a printing machine, comprising:

providing at least one temperature control device to control a temperature of the first transfer member; and controlling the temperature of the at least one temperature control device to independently maintain the temperature of the first transfer member within a predefined range.

18. The method of claim 17, wherein the at least one temperature control device comprises:

an external temperature control device adjacent and substantially external to the first transfer member.

19. The method of claim 18, wherein the external temperature control device functions to perform at least one of:

cooling a surface of the first transfer member; and heating a surface of the first transfer member.

20. The method of claim 17, wherein the at least one temperature control device comprises:

an internal temperature control device located inside the first transfer member.

21. The method of claim 20, wherein the internal temperature control device functions to perform at least one of:

cooling the first transfer member; and heating the first transfer member.

22. The method of claim 17, wherein the at least one temperature control device comprises:

an external temperature control device adjacent and substantially external to the first transfer member; and an internal temperature control device located inside the first transfer member.

23. A printing apparatus comprising:

a transfuse member;

an intermediate transfer member; and a first transfer member that electrostatically transfers a toner image from the intermediate transfer member to the transfuse member, wherein the first transfer member includes at least one temperature control device that maintains the first transfer member within a predefined range; and wherein the at least one temperature control device comprises an external cooling device that cools the first transfer member and is located adjacent and substantially external to the transfer member.

24. The printing apparatus of claim 23, wherein the external cooling device is a cooling belt.

25. The printing apparatus of claim 23, wherein the external cooling device is a cooling roller.

26. The printing apparatus of claim 23, wherein the external cooling device is an air cooler.

27. A printing apparatus comprising:

a transfuse member;

an intermediate transfer member; and a first transfer member that electrostatically transfers a toner image from the intermediate transfer member to the transfuse member, wherein the first transfer member includes at least one temperature control device that maintains the first transfer member within a predefined range; and wherein the at least one temperature control device comprises an internal cooling device that cools the first transfer member and is located inside the first transfer member.

28. The printing apparatus of claim 27, wherein the internal cooling device is at least one of an air cooler and a water cooler.

29. The printing apparatus of claim 27, wherein the at least one temperature control device further includes:

an external temperature control device located adjacent and substantially external to the first transfer member, the external temperature control device is an external cooling device that cools the first transfer member.

30. The printing apparatus of claim 29, wherein the internal cooling device is at least one of an air cooler and a water cooler.

31. The printing apparatus of claim 29, wherein the external cooling device is at least one of a cooling member, a cooling roller and an air cooler.

* * * * *